US012117256B2

(12) United States Patent
Chang et al.

(10) Patent No.: US 12,117,256 B2
(45) Date of Patent: Oct. 15, 2024

(54) FIRING PIN SYSTEM

(71) Applicants: Yo-Lun Chang, New Taipei (TW); Chen-Hung Tai, New Taipei (TW); Hwa-Nung Lee, New Taipei (TW); Yong-Fong Huang, New Taipei (TW)

(72) Inventors: Yo-Lun Chang, New Taipei (TW); Chen-Hung Tai, New Taipei (TW); Hwa-Nung Lee, New Taipei (TW); Yong-Fong Huang, New Taipei (TW)

( * ) Notice: Subject to any disclaimer, the term of this patent is extended or adjusted under 35 U.S.C. 154(b) by 57 days.

(21) Appl. No.: 18/310,564

(22) Filed: May 2, 2023

(65) Prior Publication Data

US 2023/0358494 A1 Nov. 9, 2023

(30) Foreign Application Priority Data

May 5, 2022 (TW) ..... 111117020

(51) Int. Cl.
*F41A 19/13* (2006.01)

(52) U.S. Cl.
CPC ..... *F41A 19/13* (2013.01)

(58) Field of Classification Search
CPC ..... F41A 19/13
See application file for complete search history.

(56) References Cited

U.S. PATENT DOCUMENTS 9,709,353 B1 * 7/2017 Viani ..... F41A 19/29
2019/0017773 A1 * 1/2019 Myers ..... F41A 21/30

* cited by examiner

*Primary Examiner* — Jonathan C Weber
(74) *Attorney, Agent, or Firm* — Merchant & Gould P.C.

(57) ABSTRACT

A firing pin system is adapted for underwater shooting and includes a firing pin, a blocking cap, a spring, and a rear sleeve. The firing pin has a striking tip portion, a linking end portion, and a rod body having a head section, a tail section, and a neck section interconnecting and being narrower than the head and tail sections. The blocking cap is sleeved on the neck section and has a flange that is formed with a plurality of notches adapted for allowing passage of water therethrough. The rear sleeve is sleeved on the tail section and has a plurality of outer guiding grooves. The outer guiding grooves are adapted for allowing passage of water therethrough.

6 Claims, 8 Drawing Sheets

FIRING PIN SYSTEM

CROSS-REFERENCE TO RELATED APPLICATION

This application claims priority to Taiwanese Invention patent application Ser. No. 11/111,7020, filed on May 5, 2022.

FIELD

The disclosure relates to a firing pin system, and more particularly to a firing pin system adapted for underwater shooting.

BACKGROUND

When a conventional gun is operated underwater, the conventional gun will be submerged, and since water resistance is greater than air resistance, the speed at which a firing pin of the conventional gun strikes a primer of a bullet loaded in the conventional gun is much slower underwater than when on land. Therefore, the primer of the bullet may not ignite when struck by the firing pin, and the success rate of striking the bullet's primer effectively (i.e., striking with enough force to ignite the primer which ignites propellant charge in the bullet to fire the bullet) is severely affected.

SUMMARY

Therefore, an object of the disclosure is to provide a firing pin system that can alleviate at least one of the drawbacks of the prior art.

According to the disclosure, a firing pin system is adapted for underwater shooting. The firing pin system includes a firing pin, a blocking cap, a spring, and a rear sleeve. The firing pin has a striking tip portion at a front end, a linking end portion at a rear end, and a rod body that interconnects the striking tip portion with the linking end portion and that extends in a front-rear direction. The rod body has a head section that is connected to the striking tip portion, a tail section that is connected to the linking end portion, and a neck section that is disposed between the head section and the tail section, and that is narrower than the head section and the tail section. The blocking cap is sleeved on the neck section of the rod body at a position which is adjacent to head section. The blocking cap has a main body that is connected to the neck section of the rod body, and a flange that extends radially from the main body, and that is formed with a plurality of notches being angularly spaced apart from each other and adapted for allowing passage of water therethrough. The spring is sleeved on the neck section and the tail section of the rod body, and has one end that is sleeved on the main body of the blocking cap and that abuts against the flange of the blocking cap, and another end that abuts against the rear sleeve. The rear sleeve is sleeved on the tail section of the rod body. The rear sleeve has a rear sleeve body, a slot, and a plurality of outer guiding grooves. The slot extends forwardly from a rear end of the rear sleeve body in the front-rear direction. The outer guiding grooves are formed on an outer surface of the rear sleeve body, extend in the front-rear direction, are spaced apart from each other, and are adapted for allowing passage of water therethrough. The linking end portion of the firing pin is engaged with and slidable along the slot.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
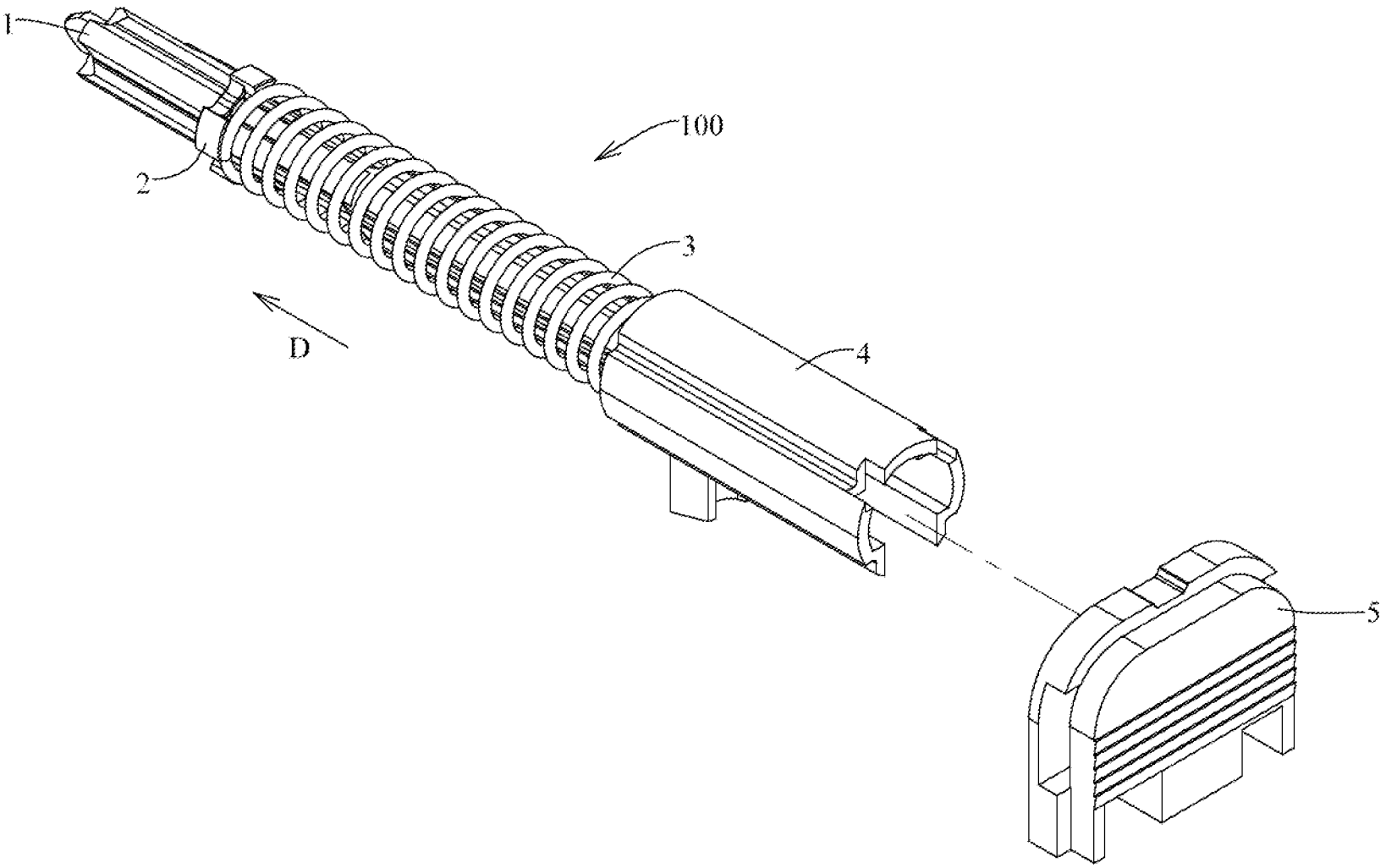
FIG. 1 is a perspective view of a first embodiment of a firing pin system according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
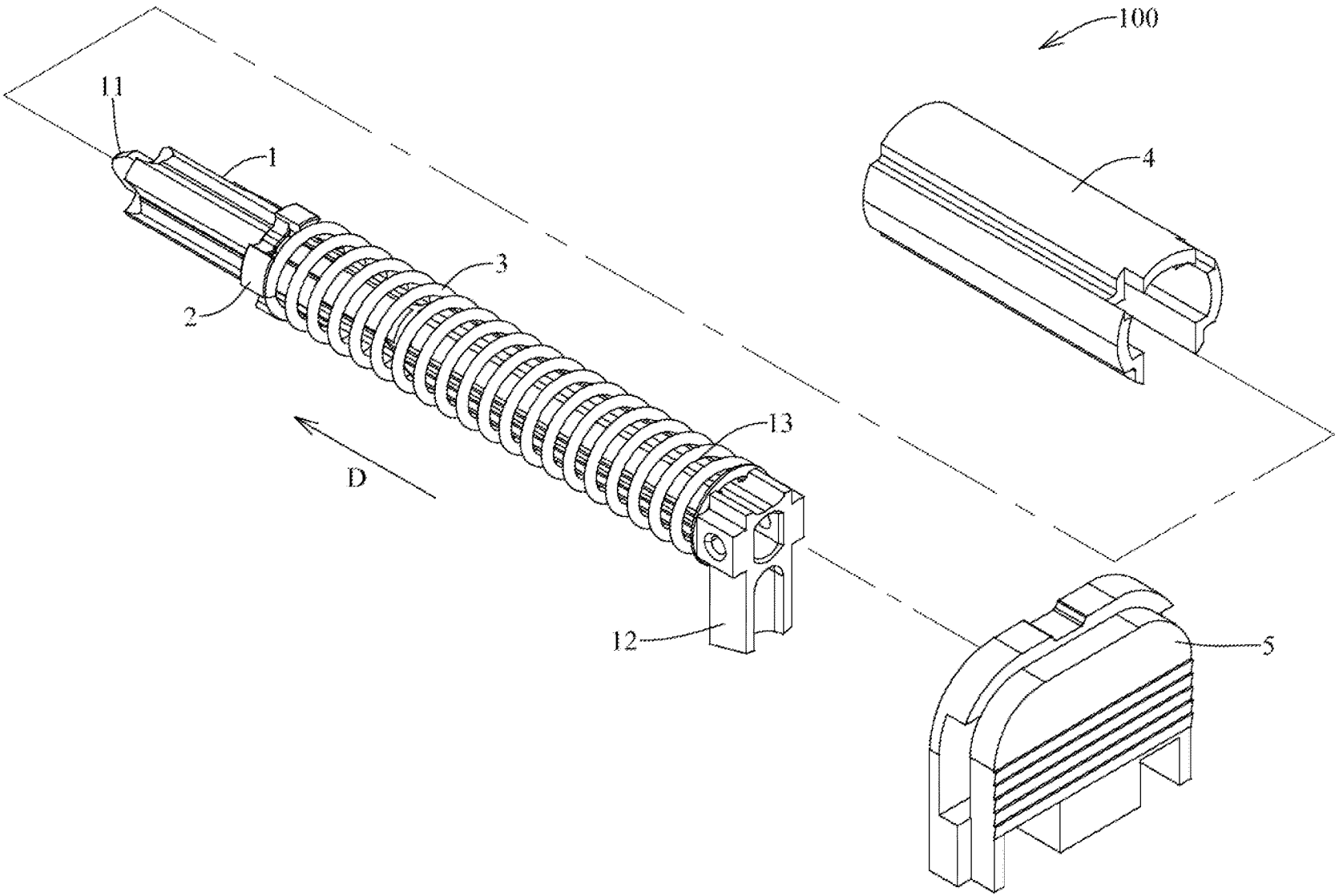
FIG. 2 is a partly exploded perspective view of the first embodiment.
Figure 3:
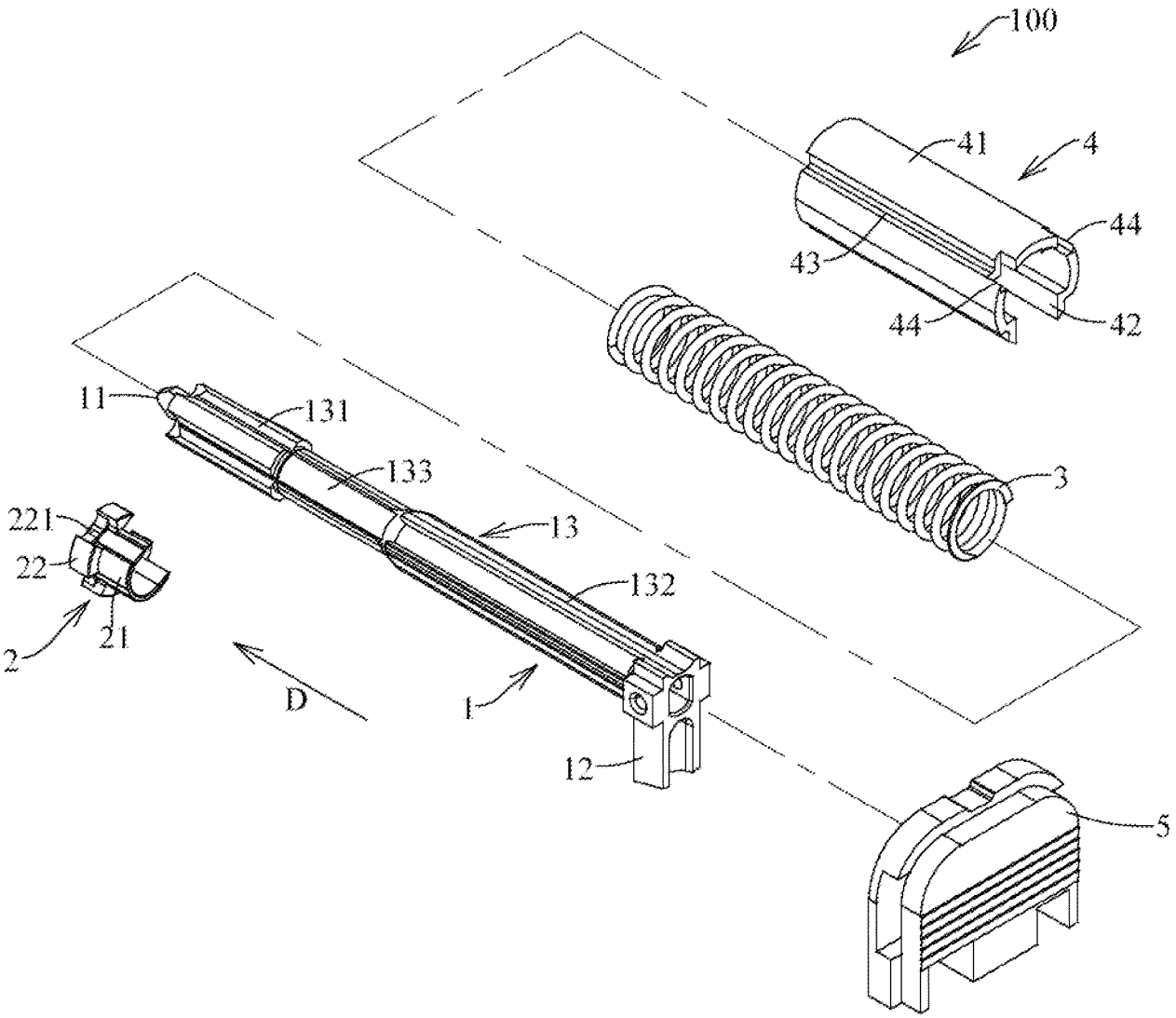
FIG. 3 is an exploded perspective view of the first embodiment.
Figure 4:
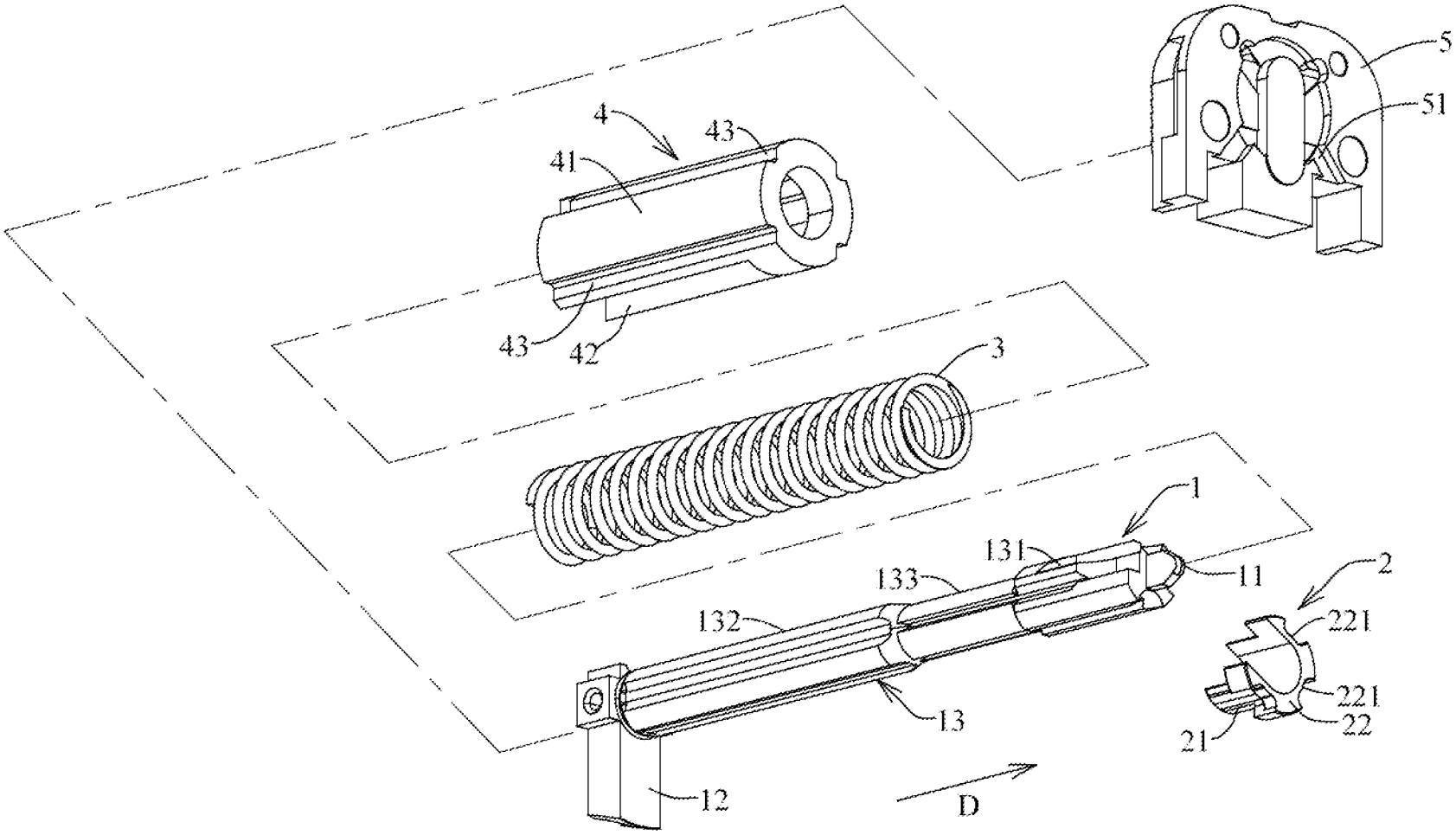
FIG. 4 is another exploded perspective view of the first embodiment.
Figure 5:
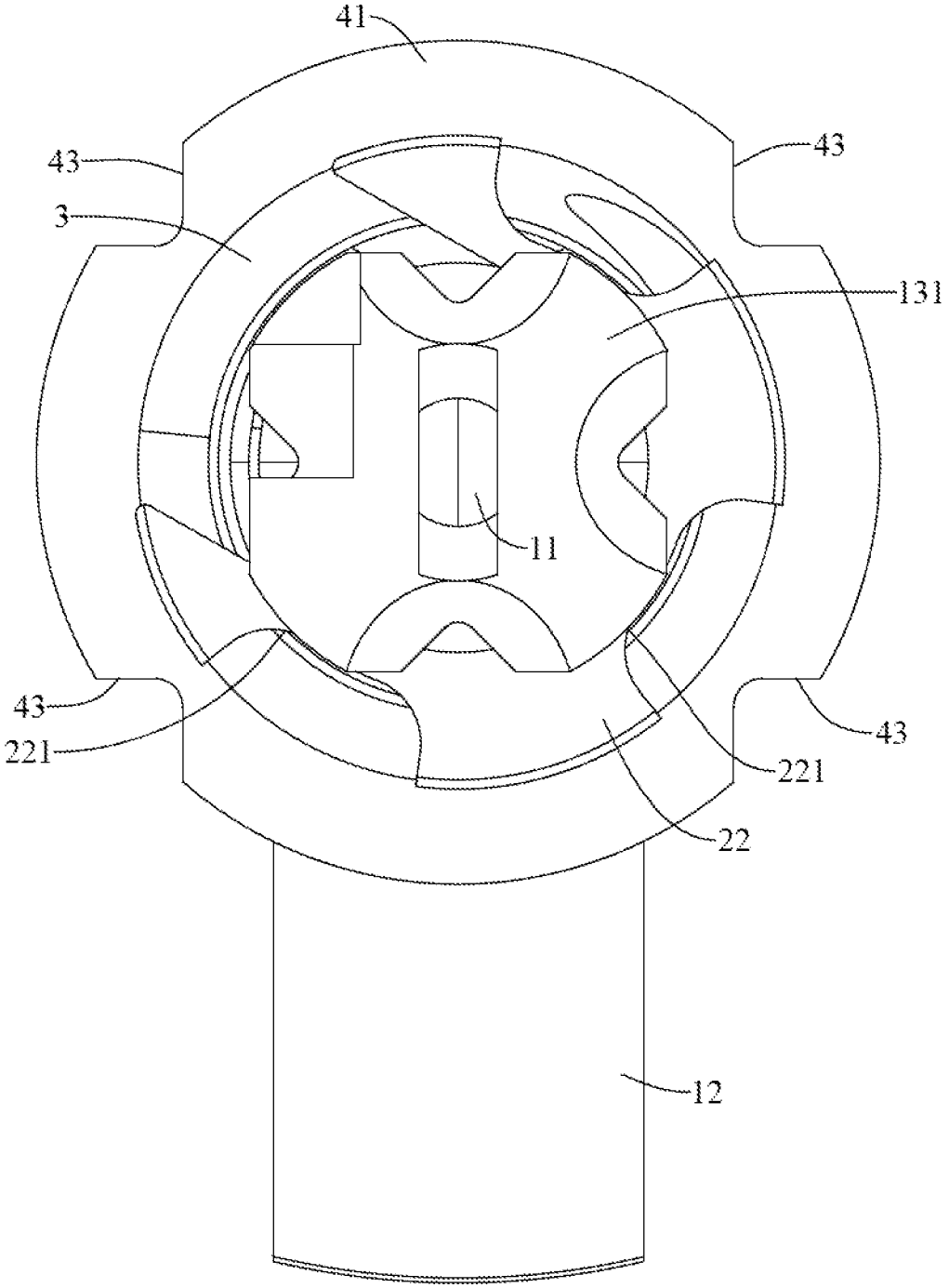
FIG. 5 is a front view of the first embodiment.

Referring to FIG. 1 to FIG. 3, a first embodiment of a firing pin system 100 according to the present disclosure is adapted to be mounted in a conventional type of Glock pistol (not shown) for underwater shooting. The firing pin system 100 includes a firing pin 1, a blocking cap 2, a spring 3, and a rear sleeve 4.

The firing pin 1 has a striking tip portion 11 at a front end, a linking end portion 12 at a rear end, and a rod body 13 that interconnects the striking tip portion 11 with the linking end portion 12 and that extends in a front-rear direction (D). The rod body 13 has a head section 131 that is connected to the striking tip portion 11, a tail section 132 that is connected to the linking end portion 12, and a neck section 133 that is disposed between the head section 131 and the tail section 132, and that is narrower than the head section 131 and the tail section 132. The linking end portion 12 of the firing pin 1 is adapted to be connected co-movably to a trigger assembly of the Glock pistol (not shown).

Referring to FIGS. 2 to 5, the blocking cap 2 is sleeved on the neck section 133 of the rod body 13 at a position which is adjacent to the head section 131. The blocking cap 2 has a main body 21 that is connected to the neck section 133 of the rod body 13, and a flange 22 that extends radially from the main body 21. The flange 22 is formed with a plurality of notches 221 that are angularly spaced apart from each other. Each of the notches 221 is defined by a curved inner surface. In some embodiments, each of the notches 221 may have a substantially semicircular profile. The notches 221 are adapted for allowing passage of water therethrough which can reduce water resistance against the firing pin 1 moving to strike a primer of a bullet, when the Glock pistol is fired underwater. In this embodiment, an inner periphery of the blocking cap 2 is U-shaped which allows the neck section 133 of the rod body 13 to fit through, thereby facilitating assembly of the main body 21 of the blocking cap 2 and the neck section 133 of the rod body 13.

The spring 3 is sleeved on the neck section 133 and the tail section 132 of the rod body 13. The spring 3 and has one end that is sleeved on the main body 21 of the blocking cap 2 and that abuts against the flange 22 of the blocking cap 2, and another end that abuts against the rear sleeve 4.

Referring to FIGS. 1 to 4, the rear sleeve 4 is sleeved on the tail section of the rod body 13. The rear sleeve 4 has a rear sleeve body 41, a slot 42, and a plurality of outer guiding grooves 43. The slot 42 extends forwardly from a rear end of the rear sleeve body 41 in the front-rear direction (D), and the linking end portion 12 of the firing pin 1 is engaged with and slidable along the slot 42. The plurality of outer guiding grooves 43 are formed on an outer surface of the rear sleeve body 41, extend in the front-rear direction (D), are spaced apart from each other, and are adapted for allowing passage of water therethrough when the Glock pistol is used underwater. The rear sleeve 4 further has a plurality of draining notches 44 that are formed in the rear end of the rear sleeve body 41. The draining notches 44 are respectively in fluid communication with corresponding ones of the outer guiding grooves 43, and are adapted for allowing discharge of water therethrough, thereby reducing water resistance acting on the firing pin 1 when the firing pin 1 strikes the primer of the bullet. In this embodiment, there are four guiding grooves 43 that are evenly distributed on left and right sides of the rear sleeve 4, and the two uppermost ones of the guiding grooves 43 respectively on the left and right sides of the rear sleeve 4, are each in fluid communication with a draining notch 44.

The operation and the working principles of the firing pin system 100 are the same as those of the conventional Glock pistol, and will not be further described herein for the sake of brevity. It should be noted that, referring to FIG. 4, the firing pin system 100 further includes a back plate 5. The back plate 5 is disposed behind and abuts against the rear sleeve 4 in the front-rear direction (D) and has two drain grooves 51 that are adapted for allowing discharge of water therethrough. However, this is not a limitation of the disclosure, and the back plate 5 may be omitted in other embodiments of the disclosure.

Figure 6:
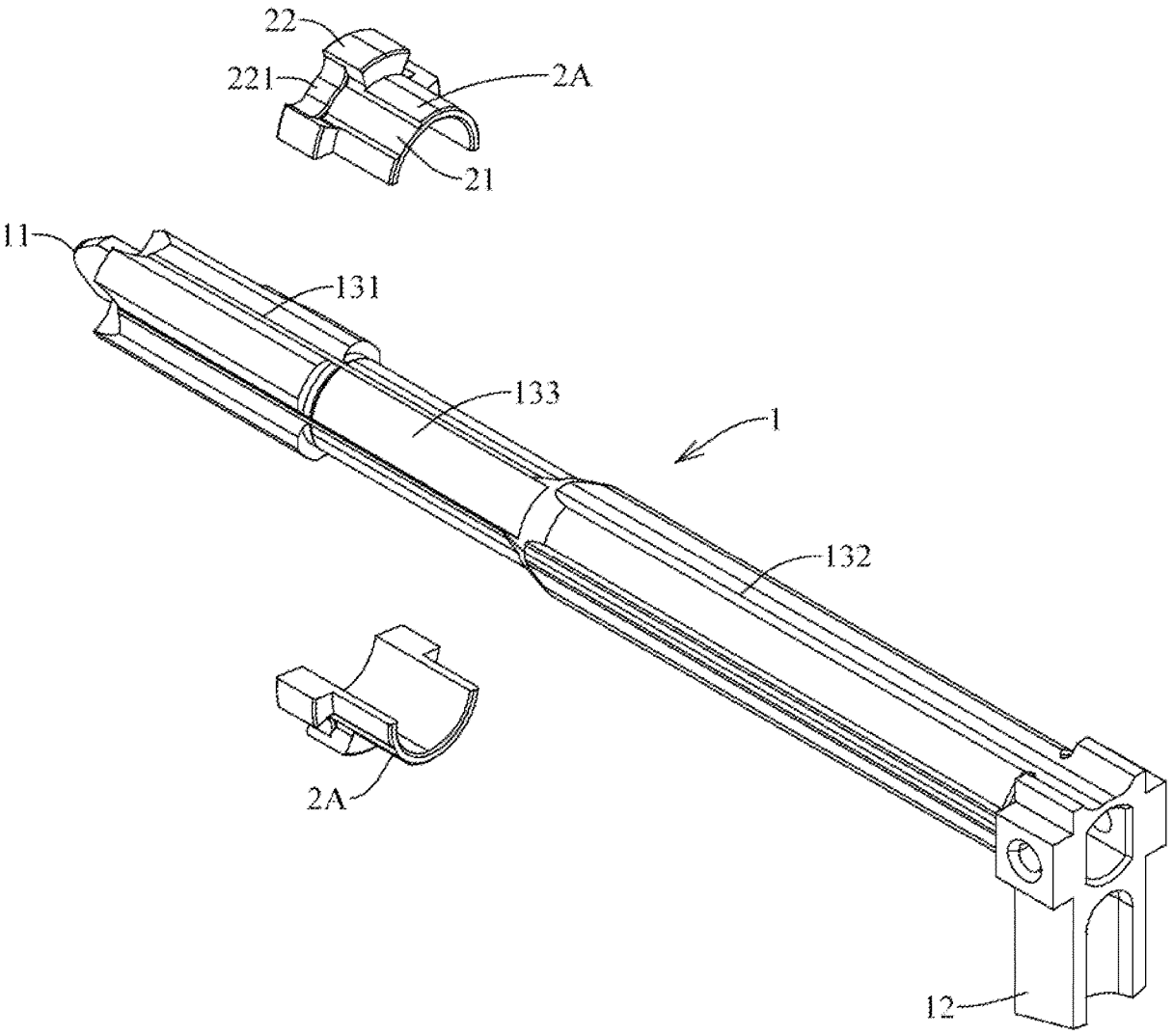
FIG. 6 is an exploded perspective view of a firing pin and a blocking cap of a second embodiment of the firing pin system according to the present disclosure.
Figure 7:
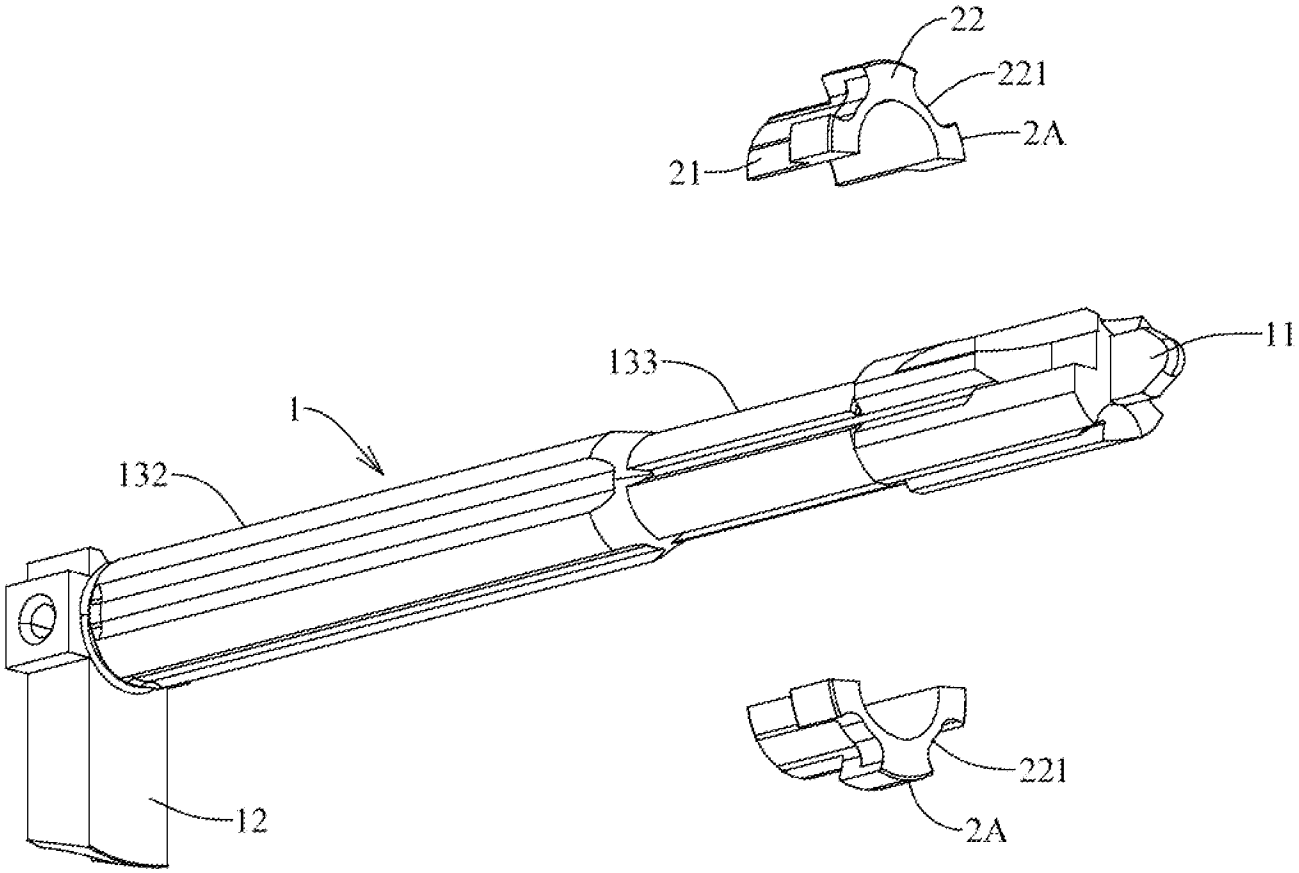
FIG. 7 is another exploded perspective view the firing pin and the blocking cap of the second embodiment.
Figure 8:
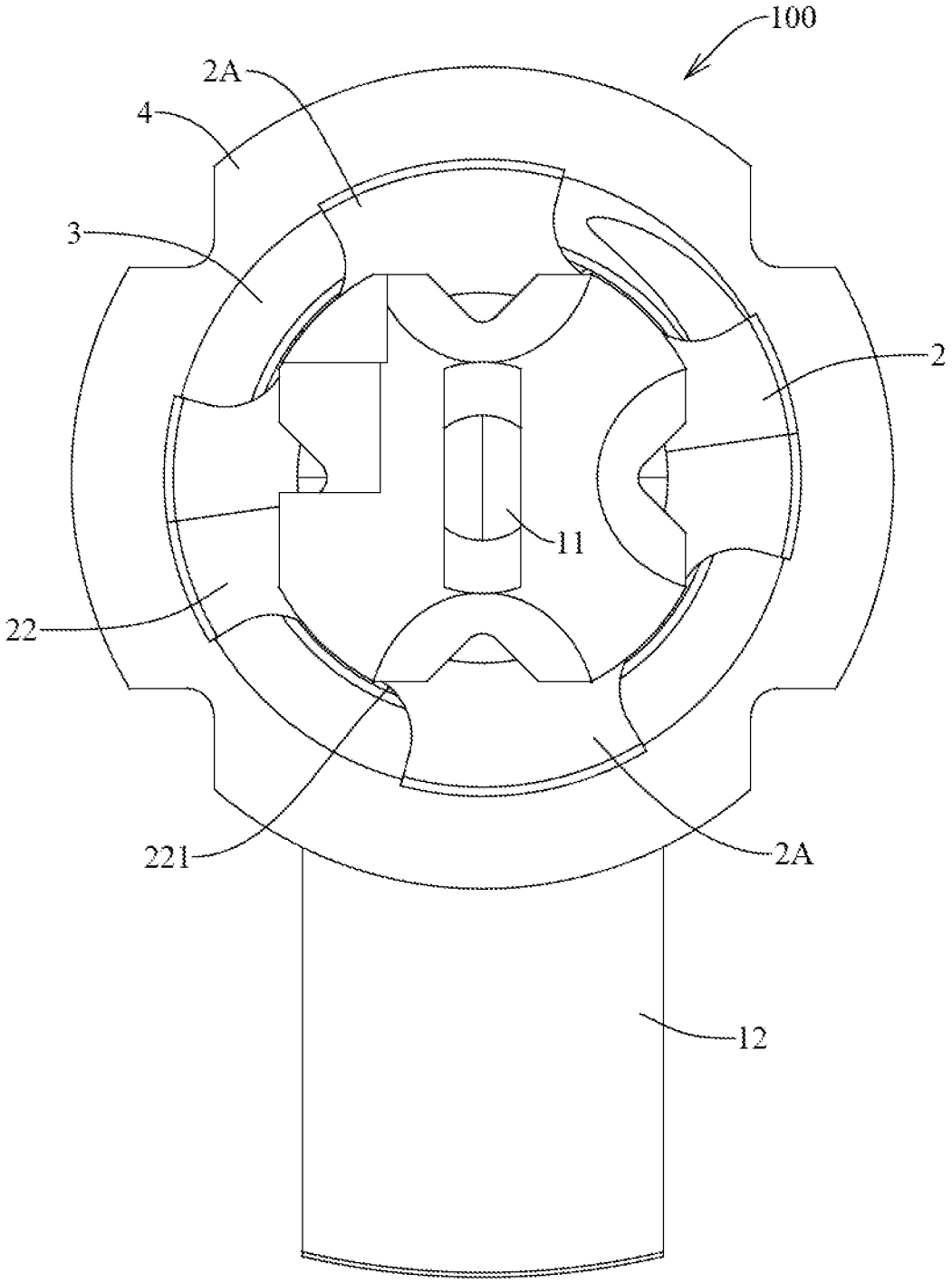
FIG. 8 is a front view of the second embodiment.

Referring to FIGS. 6 to 8, a second embodiment of the firing pin system 100 of the present invention is generally similar to the first embodiment, only differing in that, in the second embodiment, the blocking cap 2 is assembled from two half ring bodies 2A, which may surround the neck section 133 of the rod body 13 completely.

In summary, in the Glock pistol employing the firing pin system 100 according to the present disclosure, by virtue of having the notches 221 of the blocking cap 2 and the outer guiding grooves 43 of the rear sleeve 4, water resistance against the firing pin 1 can be significantly reduced when the Glock pistol is fired underwater. Additionally, by virtue of having the draining notches 44 of the rear sleeve 4, water resistance against the firing pin 1 can be reduced even further via the draining notches 44 being able to discharge water. The reduction in water resistance allows the firing pin 1 to move faster and strike the primer of the bullet more forcefully, thereby ensuring successful firing of the Glock pistol underwater.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A firing pin system adapted for underwater shooting, said firing pin system comprising:

a firing pin having
- a striking tip portion at a front end,
- a linking end portion at a rear end, and
- a rod body that interconnects said striking tip portion with said linking end portion and that extends in a front-rear direction, said rod body having a head section that is connected to said striking tip portion, a tail section that is connected to said linking end portion, and a neck section that is disposed between said head section and said tail section and that is narrower than said head section and said tail section;

a blocking cap sleeved on said neck section of said rod body at a position which is adjacent to said head section, and having
- a main body that is connected to said neck section of said rod body, and
- a flange that extends radially from said main body, and that is formed with a plurality of notches being angularly spaced apart from each other and adapted for allowing passage of water therethrough;

a spring sleeved on said neck section and said tail section of said rod body, and having one end that is sleeved on said main body of said blocking cap and that abuts against said flange of said blocking cap; and a rear sleeve sleeved on said tail section of said rod body, said spring having another end that abuts against said rear sleeve, said rear sleeve having a rear sleeve body, a slot that extends forwardly from a rear end of said rear sleeve body in the front-rear direction, and a plurality of outer guiding grooves that are formed on an outer surface of said rear sleeve body, that extend in the front-rear direction, that are spaced apart from each other, and that are adapted for allowing passage of water therethrough, said linking end portion of said firing pin being engaged with and slidable along said slot.

2. The firing pin system as claimed in claim 1, wherein said rear sleeve further has a plurality of draining notches that are formed in said rear end of said rear sleeve body, that are respectively in fluid communication with corresponding ones of said outer guiding grooves, and that are adapted for allowing discharge of water therethrough.

3. The firing pin system as claimed in claim 1, wherein an inner periphery of said blocking cap is U-shaped.

4. The firing pin system as claimed in claim 1, wherein said blocking cap is assembled from two half ring bodies.

5. The firing pin system as claimed in claim 1, wherein each of said notches is defined by a curved inner surface.

6. The firing pin system as claimed in claim 1, further comprising a back plate disposed behind and abutting against said rear sleeve, said back plate having two drain grooves that are adapted for allowing discharge of water therethrough.

* * * * *